US005518582A

United States Patent [19]

Henricson et al.

[11] Patent Number: 5,518,582

[45] Date of Patent: May 21, 1996

[54] METHOD OF AFFECTING THE SULPHUR CONTENT AND/OR SULPHUR COMPOUND COMPOSITION OF A MELT IN A RECOVERY BOILER

[75] Inventors: Kaj Henricson, Kotka; Anja Klarin, Espoo, both of Finland

[73] Assignee: A. Ahlstrom Corporation, Noormarkku, Finland

[21] Appl. No.: 939,498

[22] Filed: Sep. 8, 1992

[30] Foreign Application Priority Data

Sep. 27, 1991 [FI] Finland ..... 914585

[51] Int. Cl.[6] ..... D21C 11/06

[52] U.S. Cl. ..... 162/16; 162/30.1; 162/30.11; 423/DIG. 3

[58] Field of Search ..... 162/14, 16, 29, 162/30.1, 30.11, 51; 423/232, DIG. 3, 563

[56] References Cited

U.S. PATENT DOCUMENTS 3,867,251 2/1975 Holme ..... 162/30.1
4,439,272 3/1984 Nguyen ..... 162/30.11
4,526,760 7/1985 Empie, Jr. ..... 162/30.11
4,929,307 5/1990 Kiiskila et al. ..... 162/29

FOREIGN PATENT DOCUMENTS 990014 6/1976 Canada .

*Primary Examiner*—David L. Lacey
*Assistant Examiner*—Dean T. Nguyen
*Attorney, Agent, or Firm*—Nixon & Vanderhye

[57] ABSTRACT

The sulphur content and/or the sulphur compound composition of a melt in a recovery boiler of a pulp mill is adjusted by bringing a gas into contact with the melt. The gas may be a gaseous sulphur compound or a reducing gas. Bringing the gas into contact with the melt increases the sodium sulphide content of the melt while decreasing the sodium carbonate content, so that the sulphidity of the melt increases. The sulphur-containing gas may be produced by pressure heat treatment of black liquor, so that the black liquor burned in the recovery boiler has a lower sulphur content and thereby reduces the boiler sulphur emissions, and boiler corrosion problems.

23 Claims, 4 Drawing Sheets

METHOD OF AFFECTING THE SULPHUR CONTENT AND/OR SULPHUR COMPOUND COMPOSITION OF A MELT IN A RECOVERY BOILER

BACKGROUND AND SUMMARY OF THE INVENTION

The present invention relates to a treatment of melt in a recovery boiler so as to reduce the amount of sulphur compounds entering the recovery boiler and thus to minimize the amount of malodorous gases at the mill, the sulphur emissions from the boiler, and corrosion problems in the boiler.

In the manufacture of cellulose chemical pulp in the pulp and paper industry produced waste liquor, typically referred to as "black liquor", is normally combusted in a boiler to recover chemicals and heat. In a conventional recovery boiler the process chemicals are recovered by injecting the liquor to the boiler, whereby it dries quickly and burns under reducing conditions, generating a melt. This melt mainly contains sodium carbonate, sodium sulphide and sodium sulphate. A number of other minor compounds are present, but the essential components in the manufacture of cellulose pulp are $Na_2CO_3$ and $Na_2S$.

A large volume and variety of sulphurous gases are generated in a sulphate mill, which are combusted either in a recovery boiler or in a lime sludge reburning kiln. Particularly it is possible to generate a large volume of sulphurous gases by pressure heating black liquor, whereby a gas containing mercaptan, dimethyl sulphide, hydrogen sulphide and other components is generated. Thus, a part of sulphur may be separated from black liquor prior to the liquor being introduced to the recovery boiler, and thus the sulphur loading and the corrosion problems of the recovery boiler are reduced. However, the reduced sulphur loading also reduces the sulphur content of the melt formed in the boiler, and thus also that of the cooking liquor produced from the melt, to an unacceptably low level (i.e. the sulphur content is too low to reach the high sulphidity required in pulp cooking).

By the present invention, the sulphur content of the melt may be raised to a desired level in a simple manner. The most advantageous way to raise the sulphur content of the melt is to utilize the sulphurous off gases of the pulp mill.

In accordance with one aspect of the present invention, a method of adjusting one or both of the sulphur content and sulphur compound composition of a melt formed in a pulp mill boiler (recovery boiler) is provided. The method comprises the step of bringing at least a portion of the boiler melt into contact with a gas selected from the group consisting essentially of gaseous sulphur compounds and a reducing gas. The method may be practiced by treating a sulphurous pulp mill gas to form the gas utilized in the method, and then reacting the gas with a melt to produce an increased sodium sulphide content and an exhaust gas. The exhaust gas and melt are separated, and the exhaust gas can be used to provide heat to facilitate the reaction between the melt and the sulphur-containing or reducing gas, or it can be burned in a boiler or kiln, while the increased sodium sulphide content melt is further treated, as by dissolving it to produce green liquor, which ultimately (either by causticization or directly) can be used as a cooking liquor in the production of chemical cellulose pulp.

According to another aspect of the present invention, an apparatus for the treatment of a melt is provided. The apparatus comprises the following elements: A recovery boiler, a melt produced in a bottom portion thereof. Means defining a reaction space in communication with the recovery boiler for receiving the melt produced therein, for carrying out reactions between the melt and a gas selected from the group consisting essentially of gaseous sulphur compounds and a reducing gas. Means for supplying melt to the reaction space. Means for supplying a gas selected from the group consisting essentially of gaseous sulphur compounds and a reducing gas to the reaction space. Means for discharging reacted gas from the reaction space. And, means for discharging melt from the reaction space.

Typically the means for supplying gas to the reaction space comprises a ceramic pipe, e.g. with a nozzle at the end, for bubbling gas into the melt below the surface of the melt.

According to another aspect of the present invention, a method of reducing the sulphur emissions from, and corrosion in, a recovery boiler of a pulp mill is provided. The method comprises the steps of: (a) Pressure heating black liquor to produce sulphur-containing off gases, and to reduce the sulphur content of the black liquor. (b) Burning the black liquor in the recovery boiler to produce a melt having a lower sulphidity than if step (a) were not practiced. And, (c) bringing at least a portion of the melt produced in step (b) into contact with the sulphurous off gases from step (a) to thereby increase the sulphidity of the melt so that it has a sulphidity sufficient to be utilized as primary cooking liquor in the production of chemical cellulose pulp.

The present invention is preferably practiced by using gas containing dimethyl sulphide generated in the pressure heating of black liquor, however, the invention is not restricted to that source of gas; rather all possible sulphurous gases in a pulp mill may be employed, for example, gases from the digester house.

It is the primary object of the present invention to increase the sulphidity of a recovery boiler melt, and/or to reduce the sulphur emissions from and corrosion within a recovery boiler. This and other objects of the invention will become clear from an inspection of the detailed description of the invention and from the appended claims.

DETAILED DESCRIPTION OF THE DRAWINGS

Figure 1:
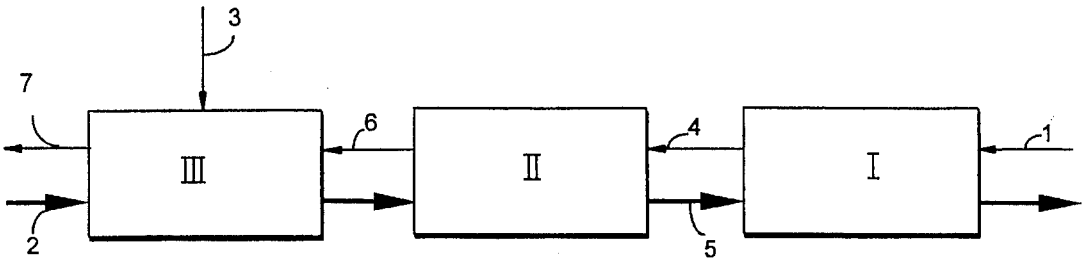
FIG. 1 is a schematic illustration of the basic method stages in the practice of the present invention.

As seen in FIG. 1, sulphur-containing gas 1 is heated in stage I, preferably by bringing it into contact with melt 2 from a recovery boiler, or a modified form (i.e. the melt 5) of the melt 2, to produce gaseous sulphur compounds. The gas 1 may be, for example, in the pressurized heat treatment of black liquor, which treatment is preferably that described in U.S. Pat. No. 4,929,307, whereby a gas containing methyl mercaptan (MM), dimethyl sulphide (DMS), hydrocarbons and hydrogen sulphide is formed. The exact composition of the gas depends on type of black liquor, temperature of the heat treatment and oxygen availability during the heat treatment. When the sulphur-containing gas is heated in stage I the main reactions are:

$$2\ MM+1.5\ O2 \rightarrow (CH_3)2S+SO_2+H_2O$$

$(CH_3)2S \rightarrow H_2S+C_2H_4$ $(CH_3)2S+1.5\ O2 \rightarrow C_2H_4+H_2O+SO_2.$ Also, reducing hydrocarbons other than ethene may form. The gas 4 is thus produced.

The gas 1 is heated to a temperature which is preferably at least 250° C., most desirably 500°–1000° C. Of the components produced from stage I, at least hydrogen sulphide and ethene are highly reducing, and thus are able to react with the hot melt 2 in the next stage, stage II. In order to intensify the reaction and to reduce the oxygen level it is possible to dry gas 1. If the temperature during the heat treatment of black liquor is high enough the gas may have decomposed completely enough so that the preheating of the gas is more or less unnecessary. It is also possible that the separate preheating of the gas 1 is unnecessary and the sulphurous gas decomposes according to above reactions when being contacted with hot melt from a recovery boiler.

In stage II the gas 4 reacts with the recovery boiler melt 2. Not all possible reactions are known, but at least the following reactions take place:

$Na_2CO_3+H_2S \rightarrow Na_2S+H_2O+CO_2$ $Na_2SO_4+C_2H_4 \rightarrow$ $Na_2S+2\ H_2O+2\ CO$ Also, other hydrocarbons are able to reduce sodium sulphate. Thus, the sodium sulphide content of the melt increases and the sodium carbonate and sodium sulphate contents decrease, in other words the sulphidity of the melt 2 increases, the high sulphidity melt 5 being produced. The splitting of sodium carbonate may be facilitated by bringing the melt 2 into contact with carbon (e.g. in graphite form). Also, it is possible that a portion of the sodium carbonate is converted to sodium oxide, which converts to sodium hydroxide when green liquor is produced from the melt 5 in conventional dissolving tanks.

The melt 5 obtained according to the invention has a substantially higher sulphidity than the original melt 2. Further, it is possible that green liquor generated from the melt 5 need not be causticized separately prior to the digester house due to the high sulphidity of the liquor, or a high $Na_2O$ content (although it is still always possible, if desired, to causticize the green liquor prior to bringing it to the digester house).

The gas-melt reactions in stage II are partially endothermic and it may thus be necessary to supply heat to the stage II reaction space by means of electric resistors or hot gases. Additional heating may also be necessary to keep the melt 2, 5 as a melt (i.e. in liquid form) particularly since the higher sodium sulphide content raises the melting point of the melt 5.

Subsequent to the melt reactions in stage II, in stage III gas 6 from stage II may be combusted by feeding combustion air 3 to stage III, and the heat of combustion contained in the gases 7 may be used for heating the melt 2 so that it has a sufficient heat content prior to the gas-melt reactions in stage II, or for generating heat in a recovery boiler or the like. The combustion in stage III may advantageously take place in some other boiler (besides the recovery boiler), aspactually if the recovery boiler is under a heavy load and the gas contains little sulphur. The gas may also be combusted so that heat is transferred to the reaction vessel of stage II indirectly. If the reactions consume a substantial amount of heat energy there is a risk of the melt 5 becoming solid, and thus heat need be added. Of course, it is also possible to use the residual gas 6 in other chemical reactions aside from combustion.

Figure 2:
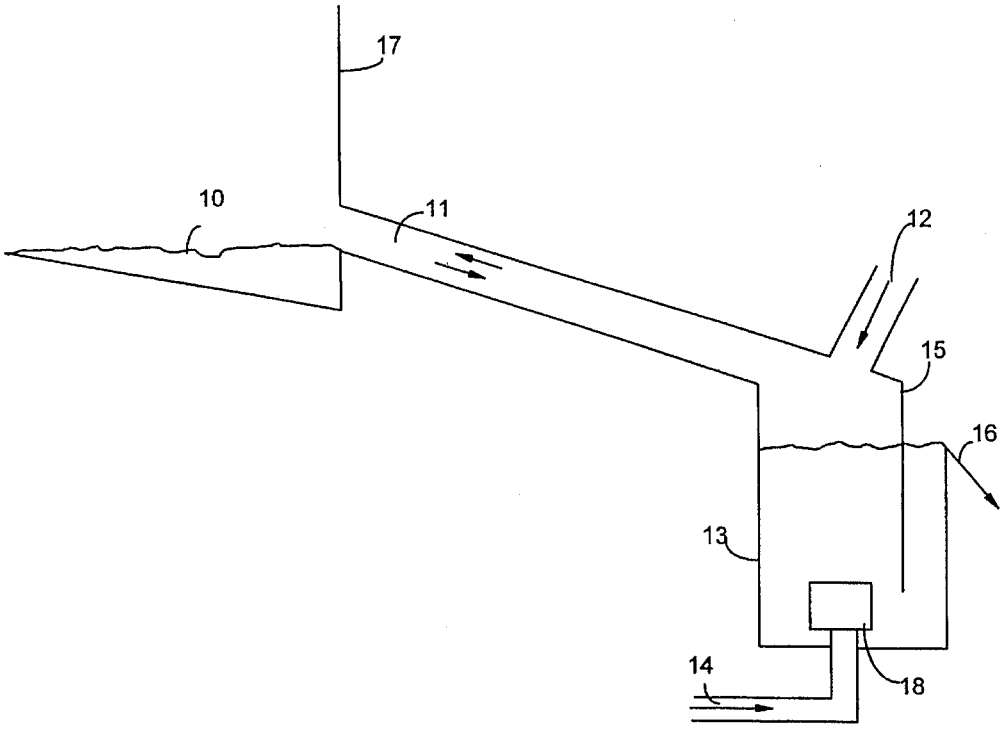
FIGS. 2 and 3 are schematic illustrations of an exemplary apparatus in accordance with the present invention.

FIG. 2 illustrates one possible specific way to technically realize the general process described above. The melt 10 flows from the bottom of the recovery boiler 17 into the combustion space 11 counter-currently to the burning gases from stage III (e.g. gases 7 in FIG. 1). The thus preheated melt 10 reacts with sulphurous gases introduced through heat resistant material (e.g. ceramic) pipe 14 and nozzle 18, underneath the melt in a reaction space 13. The sulphur gases in pipe 14 bubble through the melt (stages I and II), reacting with it. A fouling plate 15 maintains the surface of the melt high enough to carry out the reactions, and the melt exits from the reaction space to a conventional dissolving tank as overflow 16. Subsequent to the reactions, combustion air 12 is added in such a way that sub-stoichiometric oxygen conditions remain to prevent the melt 10 from oxidizing. It is also possible to keep the melt 10 flowing from the boiler 17 and the gas flowing in combustion space 11 separate from each other, e.g. by using a partition wall (not shown), whereby oxidation of the melt 10 is prevented and the heating of the melt 10 takes place by means of indirect heat transfer.

The sulphurous gas in pipe 14 is added to the reaction space 13 either alone or with a carrier gas. The purpose of the carrier gas is to ensure a sufficient flow volume, so as not to clog the nozzle 18 by which the gas is introduced under the melt 10. Suitable carrier gases are, for example, inert gases, flue gases, or carbon monoxide. In order to intensify the reactions it is possible to add carbon to the reaction space 13.

Figure 3:
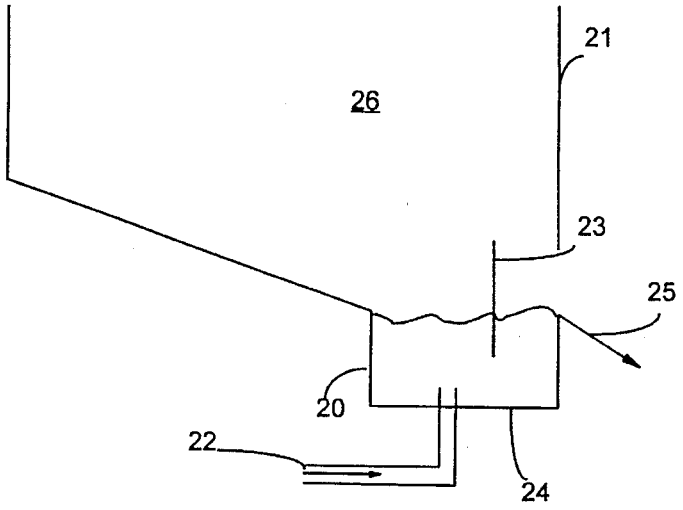

FIG. 3 illustrates a second embodiment of apparatus for realizing the gas-melt reactions according to the invention. Slag or the like may flow from the bottom of a recovery boiler (e.g. 17) and clog the combustion space of the apparatus (e.g. in FIG. 2). In FIG. 3 a reaction space 20 is located at the bottom of the recovery boiler 21, so that this problem is avoided. Sulphurous gas 22 is introduced to the reaction space 20. The fouling plate 23 maintains the surface of the melt 24 high, and the excess melt exits as overflow 25. Subsequent to the reactions, gas is combusted in a combustion space 26 above the melt 24.

The advantages gained by using the present invention are substantial compared to conventional installations. Conventionally, black liquor is injected into a recovery boiler by first evaporating water therefrom, and thereafter pyrolyzing the black liquor in the gas space of the boiler. During this time about 30–50% of the sulphur in the black liquor is evaporated to a gaseous phase and the rest falls to the bottom of the recovery boiler, where it takes part in the bed and melt reactions. The sulphur in the gaseous phase causes corrosion problems in the gas space of the boiler. Similarly, the sulphur converted to the gaseous phase is the source of the sulphur pollution of the flue gases of a recovery boiler.

Figure 4:
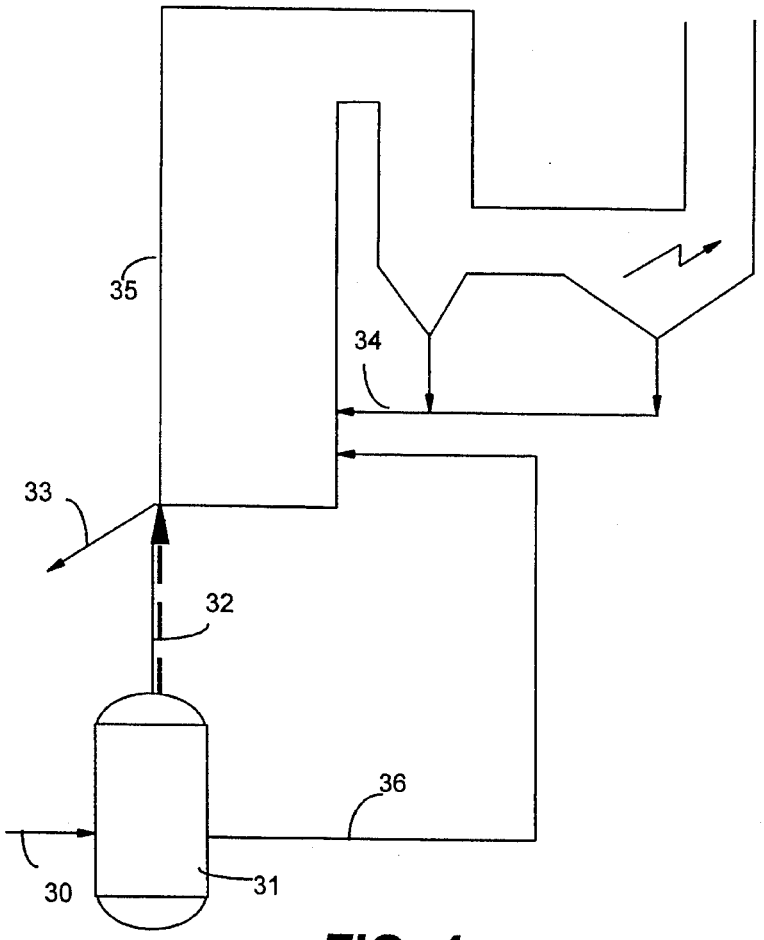
FIGS. 4, 5, 6 and 7 are schematic illustrations of alternative embodiments according to the present invention.

By a connection in accordance with FIG. 4 it is possible to decrease such problems considerably. Black liquor 30 is pressure heated in a reactor 31 (e.g. see U.S. Pat. No. 4,929,307), whereby a considerable portion of the sulphur in the liquor is removed in the form of a gas containing methyl mercaptan, dimethyl sulphide and hydrogen sulphide, in line 32. The remaining sulphur in the heat treated liquor 36 that is guided to the boiler 35 is "tightly bound", i.e., it is not easily released to the gas phase in the gas space of the boiler 35 during the drying-pyrolysis stage. Thus, the majority of the sulphur is removed from the gas space of the recovery boiler 35, whereby its corrosion problems and sulphur emissions decrease.

The sulphur gas 32 released in the pressure heating apparatus 31 is brought into contact with the melt of the boiler 35 in accordance with the present invention. Thus, melt 33 having a normal sulphur content is obtained without the necessity of the sulphur being introduced to the boiler and circulated through the gas space. Since sulphur has been separated from the black liquor prior to its being introduced to the recovery boiler, the sulphur content of the melt at the bottom of the boiler is also lower than normal, thus decreasing corrosion in the melt space. Additionally, it may be assumed that the amount of ash 34 from the boiler electrostatic filters diminishes, which again improves the efficiency of the boiler 35. If gas is transferred subsequent to the melt reactions to be combusted somewhere else outside the recovery boiler 35, the combustion load of the recovery boiler 35 may be diminished.

Figure 5:
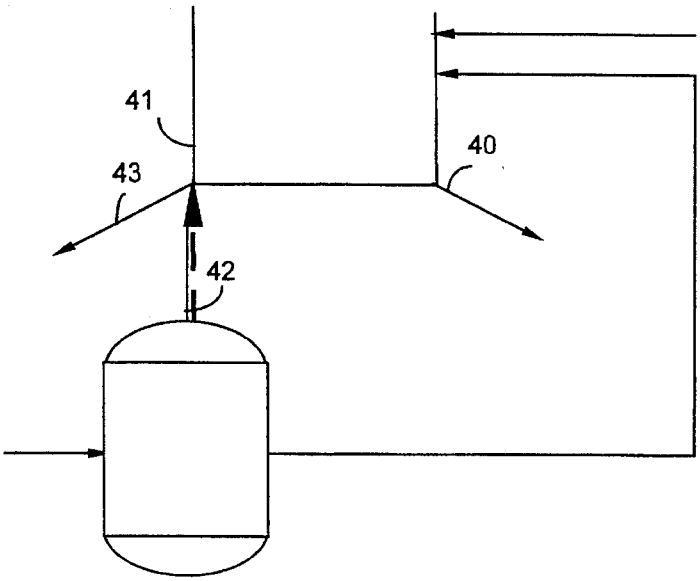

FIG. 5 illustrates an alternative way of bringing the sulphur gas into contact with the melt in a recovery boiler. A portion 40 of the melt flows out from the boiler 41 without contacting the sulphurous gas 42. Gas 42 is brought into contact only with a portion 43 of the melt. Thus two different melts are obtained, one (43) high in sulphur, and the other (40) low in sulphur. Thus, it is possible to produce cooking liquors having different sulphur contents, and thereby to improve the cooking of pulp so as to produce pulp of better quality. Cooking liquor high in sulphur is used at the beginning of the cook and liquor low in sulphur is used in the later stages of the cook (e.g. see co-pending U.S. application Ser. No. 07/887,004 filed May 22, 1992 now U.S. Pat. No. 5,326,433).

Figure 6:
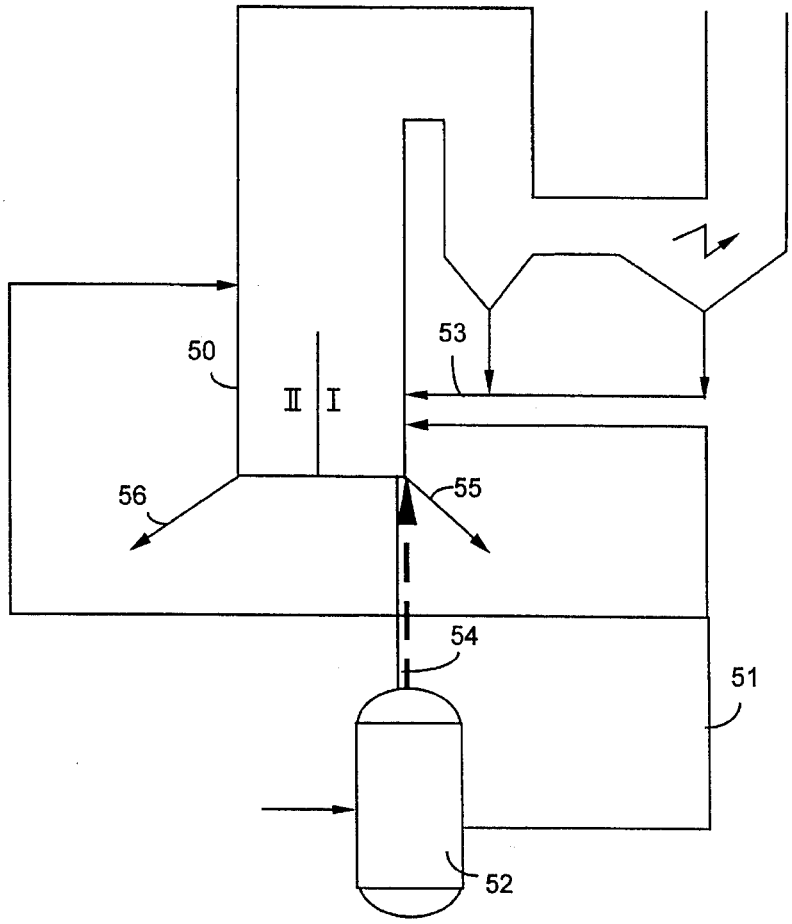

FIG. 6 illustrates an alternative connection for feeding sulphurous gas to a recovery boiler. In this embodiment, the bottom of a recovery boiler 50 is, according to co-pending U.S. application Ser. No. 07/915,235 filed Jul. 20, 1992 now U.S. Pat. No. 5,340,440, divided into two sections I and II, into which the black liquor heat treated in a reactor 52 is distributed. Additionally, sulphurous fractions, such as ash from the recovery boiler 50, generated in a pulp mill are transferred into section I. In order to decrease corrosion problems and sulphur emissions of the boiler 50 not all sulphur gases are transferred to the gas phase of a combustion chamber of the boiler 50, but the sulphurous gases 54 generated in the heat treatment of black liquor are brought into contact with the melt 55. Thus, melt 55, which is high in sulphur, is generated and at the same time boiler corrosion problems are controlled. The sulphur content of the melt 56 generated in section II is naturally lower than that in section I. How the sulphur gas generated by pressure heating of black liquor is brought into contact with the melt is described above. Similarly, it is possible to bring other sulphurous gases, such as exhaust gases from a digester house, or other gases generated in a pulp mill, into contact with the melt, in order to obtain corresponding advantages.

In case a sufficient amount of sulphurous gases is removed during the pressure heating of black liquor, it is possible to combust at least a portion of the black liquor in oxidizing conditions. A recovery boiler designed for oxidizing combustion is simpler and easier to operate than conventional recovery boilers, since it is not necessary to maintain a bed, a melt and reducing conditions at the bottom of the boiler. The oxidized melt is treated according to the invention by gaseous sulphur compounds and/or reducing gas, such as ethane, whereby melt containing $Na_2S$ is obtained and green liquor therefrom. Such a recovery system (a recovery boiler and a combination of a boiler operating in oxidizing conditions) is suitable, for example, for mills in which a recovery boiler is overloaded and a portion of the black liquor is combusted under oxidizing conditions. Such an arrangement is disclosed in FIG. 7.

Figure 7:
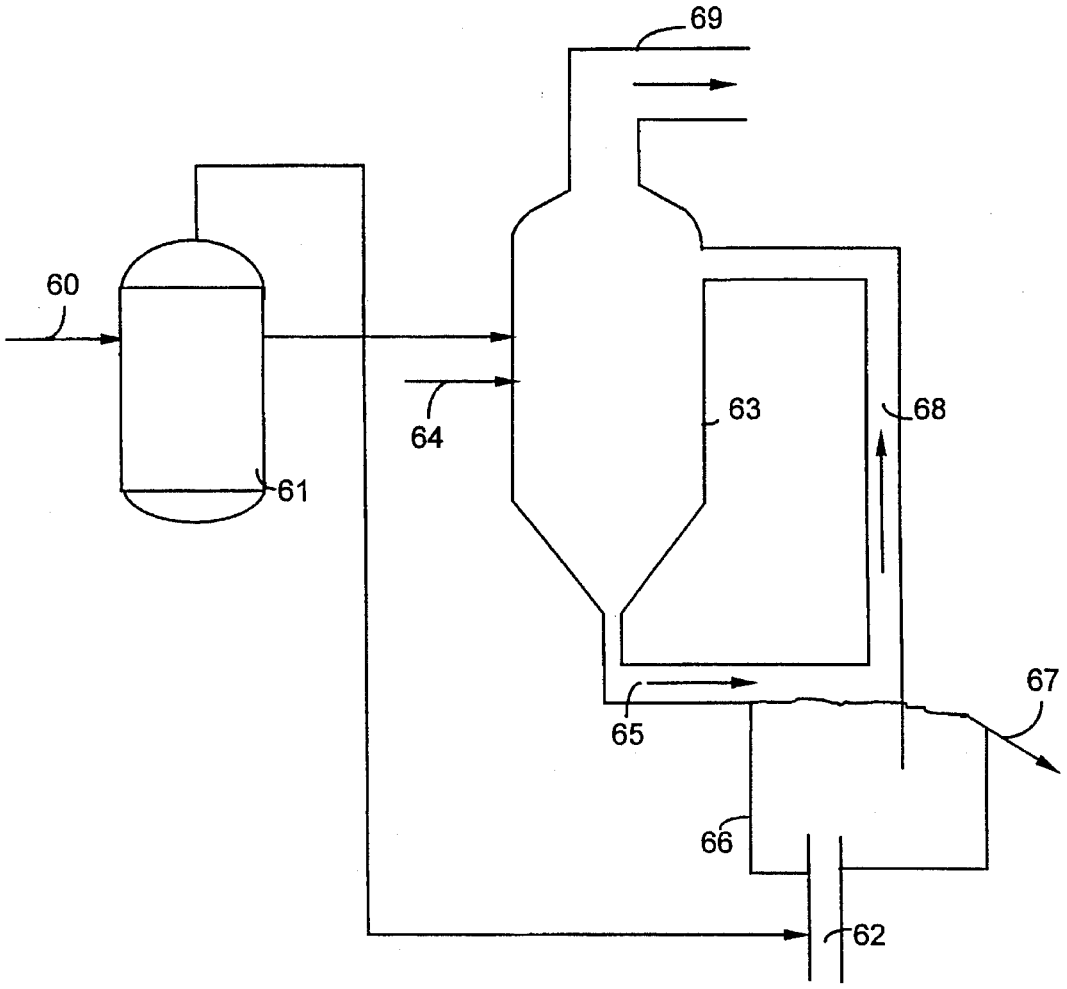

In FIG. 7, liquor 60 from a pulp mill evaporation plant is heat treated in a reactor 61, whereby sulphurous gases 62 are generated. The black liquor from reactor 61 is transferred to a vessel 63 for oxidizing combustion, for which combustion air 64 is introduced. The oxidized melt 65 is transferred from the vessel 63 to a reducing reactor 66, into which the sulphurous gases 62 generated by heat treatment are also fed. In the reducing reactor 66 sodium sulphide is generated as a result of at least two reactions: the hydrogen sulphide in the gas reacts with the oxidized molten sodium carbonate, and the ethene of the gas reacts with the molten sodium sulphate. Hydrogen sulphide and ethene are generated when dimethyl sulphide splits during the heat treatment of black liquor and/or heating of the sulphurous gas. Thus, melt high in $Na_2S$ is obtained, and it is discharged as overflow 67 for the manufacture of cooking liquors. Gases 68 are fed from the reaction space 66 to be used in combustion in the vessel 63, and hot gases 69 are discharged to heat recovery apparatus (not shown).

The gases exiting from the gas-melt-reaction spaces of FIGS. 1, 2, 3 and 7 contain less sulphur than the gas introduced in the melt. These gases, from which at least part of the sulphur is removed, may also be used as fuel in other combustion apparatus, such as in a lime reburning kiln, a bark boiler, or the superheating section of a recovery boiler.

Sulphur-containing gas is typically injected into the melt under pressure for three reasons: 1) to overcome the static head of melt, 2) to reduce the volume of the gas in order to improve contact between the gas and melt, and 3) to insure that both the gas and melt are pressurized in order to reduce volatilization of sodium during the treatment of the smelt. This volatilization may be a problem if the melt is heated. The gas/melt reactions may be performed under different pressures.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A method of affecting one or both of the sulphur content and sulphur compound composition of a melt formed in a pulp mill boiler, comprising the step of (a) during or altar discharging formed melt from the boiler, bringing at least a portion of the boiler melt into contact with a reducing gas containing ethene.

2. A method as recited in claim 1 wherein the boiler comprises a recovery boiler, and wherein step (a) is practiced by introducing the gas into a reaction space at the bottom of the recovery boiler, below the level of melt in the reaction space.

3. A method as recited in claim 1 comprising the further step of withdrawing melt from two different portions of the boiler, and practicing step (a) with respect to melt withdrawn from one portion, while not treating the melt withdrawn from the other portion, so as to produce two melts with different sulfidities.

4. A method of affecting one or both of the sulphur content and sulphur compound composition of a melt formed in a pulp mill boiler, comprising the step of (a) bringing at least a portion of the boiler melt into contact with a reducing gas containing ethene.

5. A method of affecting one or both of the sulphur content and sulphur compound composition of a melt formed in a pulp mill boiler, comprising the step of (a) during or after discharging formed melt from the boiler, bringing at least a portion of the boiler melt into contact with a gas containing hydrogen sulfide.

6. A method of affecting one or both of the sulphur content and sulphur compound composition of a melt formed in a pulp mill boiler, comprising the step of (a) during or after discharging formed melt from the boiler, bringing at least a portion of the boiler melt into contact with a sulphurous gas containing hydrogen sulfide and ethene, and/or dimethyl sulphide.

7. A method of affecting one or both of the sulphur content and sulphur compound composition of a melt formed in a pulp mill boiler, comprising the step of (a) during or after discharging formed melt from the boiler, bringing at least a portion of the boiler melt into contact with a gas selected from the group consisting essentially of gaseous sulphur compounds and a reducing gas; and wherein step (a) is practiced by:

(i) treating a sulphurous gas to form a gas selected from the group consisting of gaseous sulphur compounds and reducing gas;

(ii) reacting the gas from step (i) with the melt to produce a melt with an increased sodium sulphide content, and to produce exhaust gas; and (iii) separating the exhaust gas and melt, and further treating the melt.

8. A method as recited in claim 7 comprising the further step of applying heat during the practice of step (ii).

9. A method as recited in claim 8 comprising the further step of combusting the exhaust gas from step (iii) to produce a hot gas, and passing the hot gas into heat exchange relationship with the melt prior to the melt being treated in step (ii).

10. A method as recited in claim 7 comprising the further step of combusting the exhaust gas from step (iii) to produce a hot gas, and passing the hot gas into heat exchange relationship with the melt prior to the melt being treated in step (ii).

11. A method as recited in claim 7 comprising the further step of combusting the exhaust gas from step (iii) in a boiler or a kiln.

12. A method as recited in claim 7 wherein step (iii) is practiced by dissolving the melt to produce green liquor, and then ultimately utilizing the green liquor in the production of chemical cellulose pulp.

13. A method as recited in claim 7 wherein step (a) is practiced by entraining the gas in a carrier gas prior to bringing the gas into contact with the melt.

14. A method as recited in claim 7 comprising the further step of adding carbon to the melt prior to or simultaneously with the practice of step (a).

15. A method of affecting one or both of the sulphur content and sulphur compound composition of a melt formed in a pulp mill boiler, comprising the step of (a) during or after discharging formed melt from the boiler, bringing at least a portion of the boiler melt into contact with a gas selected from the group consisting essentially of gaseous sulphur compounds and a reducing gas, by entraining the gas in a carrier gas prior to bringing the gas into contact with the melt.

16. A method of affecting one or both of the sulphur content and sulphur compound composition of a melt formed in a pulp mill boiler, comprising the steps of: (a) during or after discharging formed melt from the boiler, bringing at least a portion of the boiler melt into contact with a gas selected from the group consisting essentially of gaseous sulphur compounds and a reducing gas; and (b) adding carbon to the melt prior to or simultaneously with the practice of step (a).

17. A method of affecting one or both of the sulphur content and sulphur compound composition of a melt formed in a pulp mill recovery boiler, comprising the step of (a) during or after discharging formed melt from the boiler, bringing at least a portion of the boiler melt into contact with a gas selected from the group consisting essentially of gaseous sulphur compounds and a reducing gas, by introducing the gas into a reaction space at the bottom of the recovery boiler, below the level of melt in the reaction space.

18. A method of affecting one or both of the sulphur content and sulphur compound composition of a melt formed in a pulp mill boiler, comprising the steps of (a) during or after discharging formed melt from the boiler, bringing at least a portion of the boiler melt into contact with a gas selected from the group consisting essentially of gaseous sulphur compounds and a reducing gas; (b) withdrawing melt from two different portions of the boiler; and (c) practicing step (a) with respect to melt withdrawn from one portion, while not treating the melt withdrawn from the other portion, so as to produce two melts with different sulfidities.

19. A method of treating melt in a recovery boiler, comprising the steps of:

(a) burning black liquor in the recovery boiler to produce a melt, the melt after formation establishing a liquid level; and (b) below the liquid level of the melt, introducing into the melt a gas selected from the group consisting essentially of gaseous sulphur compounds and a reducing gas to thereby change one or both of the sulphur content and sulphur compound composition of the melt.

20. A method as recited in claim 19 wherein step (b) is practiced in a reaction space at the bottom of the recovery boiler, and wherein the melt is withdrawn from the reaction space by allowing it to overflow once it reaches a certain level.

21. A method of reducing sulphur emissions from, and corrosion in, a pulp mill recovery boiler, while producing a melt having a sufficiently high sulphidity to be useful as primary cooking liquor for producing sulphate cellulose pulp, comprising the steps of:

(a) pressure heating black liquor to produce sulphur-containing off gases, and to reduce the sulphur content of the black liquor;

(b) burning the black liquor in the recovery boiler to produce a melt having a lower sulphidity than if step (a) were not practiced; and (c) bringing at least a portion of the melt produced in step (b) into contact with the sulphurous off gases from step (a) to thereby increase the sulphidity of the melt so that it has a sulphidity sufficient to be utilized as primary cooking liquor in the production of sulphate cellulose pulp.

22. A method as recited in claim 21 comprising the further step of adding carbon to the melt prior to or simultaneously with the practice of step (c).

23. A method as recited in claim 21 wherein step (c) practiced by entraining the gas in a carrier gas prior to bringing the gas into contact with the melt.

* * * * *